United States Patent [19]

Pinion et al.

[11] 4,319,593

[45] Mar. 16, 1982

[54] METHOD FOR HIGH CONSISTENCY REFINING OF TOBACCO FOR FILM CASTING

[75] Inventors: Dallas O. Pinion, Colonial Heights; William W. Sadler, Chester, both of Va.

[73] Assignee: American Brands, Inc., New York, N.Y.

[21] Appl. No.: 51,459

[22] Filed: Jun. 22, 1979

[51] Int. Cl.[3] ..... A24B 3/14

[52] U.S. Cl. ..... 131/372

[58] Field of Search ..... 131/140, 140 C, 140 P, 131/17 R, 17 A, 17 AC, 17 AD, 17 AE, 133 R, 372

[56] References Cited

U.S. PATENT DOCUMENTS

| | | | |
|---|---|---|---|
| 2,707,472 | 5/1955 | Jurgensen et al. | 131/17 AE |
| 3,097,653 | 7/1963 | Gooijer | 131/17 AE |
| 3,125,098 | 3/1964 | Osborne | 131/140 C X |
| 3,464,422 | 9/1969 | Light et al. | 131/17 A |
| 3,646,943 | 3/1972 | Blewitt et al. | 131/17 AE X |
| 4,182,349 | 1/1980 | Selke | 131/17 AE X |

*Primary Examiner*—Stephen C. Pellegrino

*Attorney, Agent, or Firm*—Pennie & Edmonds

[57] ABSTRACT

A process for making cast film from all-tobacco material which includes mixing particles of tobacco materials, adjusting the water content of said mixture, refining the tobacco slurry to a CS freeness of about −500 ml to about −900 ml, passing the slurry as necessary through a colloid mill, diluting the so treated slurry with water and casting the slurry on a non-porous surface. The cast film is then dried, remoistened and removed.

3 Claims, No Drawings

METHOD FOR HIGH CONSISTENCY REFINING OF TOBACCO FOR FILM CASTING

BACKGROUND ART

Tobacco materials used in making reconstituted tobacco sheets, whether using all-tobacco or using tobacco plus binders, require grinding or refining as parts of their preparation for use in the manufacturing process. Refining includes cutting, disturbing the fibrous arrangement, and otherwise working, sizing and preparing the tobacco material for use as a part of the slurry to be extruded on a wire or screen or, alternatively, cast to form a film or sheet.

Prior methods of making reconstituted sheets have described the amount or degree of refinement in terms of pulp freeness or particle size. For example, U.S. Pat. No. 3,464,422 describes a method of refining a slurry of tobacco stock to a Schopper-Riegler value of −100 millimeters (ml); U.S. Gooijer U.S. Pat. No. 3,097,653 refines the tobacco by grinding it until 30% is retained on a 100 mesh sieve and 99% passes through an 18 mesh sieve; Osborne U.S. Pat. No. 3,125,098 discloses a process in which refinement is defined by inverted or negative freeness as measured by the Canadian Standard Freeness (CSF) test and finally Domeck U.S. Pat. No. 3,115,882 uses a Clark Classifer screen to measure the degree of wet grinding.

SUMMARY OF THE INVENTION

The present invention provides an improved method of refining and further preparing a slurry for casting in which the extent or degree of refining is measured by the CS freeness test. By controlling the refining of the tobacco material, using a colloid mill to assure a smooth slurry and through other steps set forth herein, the present process permits formation of a cast sheet using only tobacco materials without the use of film formers, linking agents, binding agents or non-tobacco materials. It is a feature also that the present process makes unnecessary any mechanical pretreatment of the tobacco material nor is any extraction required.

Broadly, the present invention comprises refining tobacco materials to a degree of freeness in the range of −500 to −900 ml on the CS scale, using the so-refined material to make a slurry having at least 5% solids which slurry does not include added non-tobacco fibrous materials, cross linking agents or binder materials, and casting the slurry on a non-porous surface.

DESCRIPTION OF THE INVENTION

Any tobacco material may be used including leaf tobacco, cut or shredded tobacco, stems or fines. The tobacco material is mixed with water, hot or cold, to achieve a 20 to 60% by weight tobacco material in the mixture and the mixture is then refined, in any suitable refiner, to a CSF of −500 to −900 ml. Refining to this degree results in a substantial portion of the tobacco particles being reduced to less than about 1 mm in size. The refining may be done under atmospheric pressure or in a steam pressure system. If done in a steam pressure system the tobacco should be essentially dry during the refining operation.

Refined tobacco is then diluted with water until about 5 to about 15%, by weight, solids is reached and the resultant slurry put through a colloid mill to remove any agglomerates therein. Finally, the slurry is cast on a non-porous moving belt or any known casting arrangement to form, after drying, a sheet of tobacco.

It is a feature that no film formers, no binders or non-tobacco fibers are used in the practice of the invention.

The following are Examples of the practice of the invention:

EXAMPLE 1

A blend of tobacco material was brought to 80% moisture content with water and then circulated through a disc refiner until a −800 ml CS freeness was attained. A mixture of Burley and flue-cured stems were also subjected to the same treatment until a CS freeness of −800 ml was reached. Both the refined tobacco and the refined stems were of a thick pasty consistency.

The refined stems were combined with the refined tobacco in a 1:4 ratio. After the addition of humectants, sugars, and other standard tobacco additives, the mixture was diluted with water to a consistency suitable for casting on a stainless steel belt. Hot air and steam impingement were used to dry the tobacco slurry which was then remoistened and removed from the belt as a tobacco sheet.

The tobacco sheet had the following physical characteristics: a thickness of 0.0048 in., as measured with a caliper, a tensile strength of 546 g/in. width, MD (Machine direction) and a finished weight of 54 g/m$^2$. The sheet was light brown in color and had a good appearance. Cigarettes made from the cut sheet were judged to have good tobacco character when smoked.

EXAMPLE 2

A mixture of stems and tobacco fines was thoroughly wetted with hot tap water and mixed to form a mixture having a 40% by weight solids content. The mixture was refined to a CSF of −700 milliliters. The refined tobacco was diluted to about 10 percent by weight solids and the glycerine content was adjusted to give about 5% by weight in the finished product.

The mixture was then passed through a colloid mill with the solids content adjusted to 8% by weight using water and the temperature of the mixture was adjusted to about 55° C. The colloid mill removed agglomerates without further refining of the material. The slurry was then cast on a continuously moving stainless steel belt. The finished product weighed 65 to 90 grams per square meter and had a thickness of 0.005 to 0.008 inches. The tensile strength was 200 to 600 grams per inch.

EXAMPLE 3

A thirty-pound blend of tobacco components consisting of leaf, leaf fines, stems and stem fines was broken as necessary to cause the blend to pass through a screen having one-half inch openings. The blend was then thoroughly mixed with 102 pounds of hot tap water and allowed to equilibrate for one-half hour. The wet mass was pumped by a Moyno pump to a Sprout-Waldron double-disc refiner (Model 12-TF) set at about zero plate clearance for refining. The satisfactorily refined stock was diluted to 5% solids, conventional tobacco flavorants and humectants were added and the slurry was formed into a thin continuous film on an endless stainless steel, belt, fourteen (14) inches wide and twenty-three (23) feet long, using two consecutive casting knives. While on the moving belt, the film was dried by hot air and remoistened with steam. It was then removed as a continuous sheet from the belt by a doctor blade.

Physical properties of the cast product were: basis weight 55 gms/m$^2$; caliper 0.0048 in.; tensile strength 850 g/in. MD. A panel of smokers compared hand-rolled cigarettes made from this sheet with cigarettes made from the same raw materials using the Fourdrinier method. Cigarettes made from the cast sheet were preferred because they provided more tobacco taste and a smoother smoke.

EXAMPLE 4

Whole oriental leaf was cut to pass through a one-half inch mesh screen. The cut tobacco was refined using a Sprout-Waldron refiner (Model R-12-M) according to the procedure in Example 3. Refining in this example was continued until the freeness became negative and reached a CSF value of −800 ml. Oriental leaf scraps were also refined to −800 ml CSF according to the above procedure.

Equal parts of the two refined stocks were then combined and the resultant blend was mixed and diluted with sufficient water to give a slurry containing 5.3% solids. Humectant was added and the slurry was cast as a thin continuous film on an endless stainless steel belt using a metering roll. After drying with hot air above the belt and impinged steam beneath the belt, the film was remoistened with steam and removed from the belt as a continuous sheet using a doctor blade.

The basis weight of the sheet was 70 g/m$^2$. Cigarettes were made in which this cast product was substituted for oriental leaf tobacco in the cigarette blend. Control cigarettes contained the leaf tobacco. A panel of smokers did not detect a significant difference in the smoking properties of the test cigarettes versus the control cigarettes

EXAMPLE 5

The blend of tobacco components described in Example 3 was ground in a Wiley mill to pass through a one-half inch mesh screen. This blend after refining was cast according to the description given in Example 4. Physical properties of the sheet were: basis weight 70 g/m$^2$; caliper 0.0055 in.; tensile strength 371 g/in. MD. Smoke taste of cigarettes containing this product were preferred by a panel of smokers over a similar blend in which a Fourdrinier-made product replaced the cast product.

EXAMPLE 6

A 1:1 mixture of stem fines and tobacco dust containing less than 6% sand was adjusted to 70% moisture and refined to −870 ml CSF by eight separate passes through a refiner (Sprout-Waldron, Model R-12-M) set at less than 0.001 inch plate clearance. Small agglomerated masses of fiber and fibrils began to appear after the fourth pass and most of the stock appeared to be in this state after the eighth pass. The moisture content had decreased to 67%. A portion of the refined stock was mixed and diluted with water to 12% solids. Humectant was added. The slurry was watery and a large portion of the fiber and fibrils appeared to remain in small agglomerated masses.

The slurry was pumped (Moyno, Model 2L6) at 20 psig through a colloid mill (Sonic Tri-Homo, Model 4LA; 60 grit rotor ans stator stones) set at about 0.0005 inch rotor-stator clearance. The feed rate was 21 lbs/min. One pass through the colloid mill produced a slurry which was creamy and well dispersed and devoid of small agglomerated masses of fibers and fibrils. The slurry was diluted to 6% solids with water, heated to about 65° C. and then formed into a cast sheet as described in Example 4; belt speed was about 5 ft/min. and roll speed was about 7.5 ft/min.

The physical properties of the tobacco sheet were: basis weight 73.2 g/m$^2$; average thickness 0.0063 in.; tensile strength 360 g/in. MD.

EXAMPLE 7

The wet tobacco mixture described in Example 6 was refined to −870 ml CSF by nine separate passes through the refiner with plate clearance set at about 0.001 inch. The refined stock, which appeared as described in Example 6 was diluted with water to give a slurry containing 7% solids. Humectant was added and the mixture was recirculated through a Moyno pump (Model 2F2) for about 20 minutes. The small agglomerates of fiber were dispersed to give a slurry suitable for casting.

The slurry was fed to the metering roll at 6 ft/min. from a tail pulley casting box having an adjustable roll with variable speed instead of the conventional adjustable gate. The film was dried, remoistened and doctored from the belt in sheet form.

Physical properties of the tobacco sheet were: basis weight 72.1 g/m$^2$; caliper 0.0067 in.; tensile strength 560 g/in. MD and 640 g/in. CD (Cross Sheet Direction).

EXAMPLE 8

The tobacco mixture of Example 6 was refined to −870 ml CSF after ten passes through a double-disc refiner set at near zero plate clearance. Final moisture was about 70%. Agglomerated masses of fiber, which became apparent after eight passes, were readily dispersed by adjusting the moisture to 80% and subjecting the wet mass to two additional refiner passes at 0.002 to 0.003 inch plate clearance. Solids content of the dispersion was adjusted to 8% with water and humectant was added prior to casting as a continuous film on an endless stainless steel belt.

The film was dried, remoistened, and removed from the belt in sheet form having the following physical properties: basis weight 73 g/m$^2$; caliper 0.0065 in.; tensile strength 373 g/in. MD. and 463 g/in. CD.

EXAMPLE 9

The wet tobacco mixture of Example 6 was refined to −800 ml CSF after seven passes at near zero plate clearance. Water which was introduced into the refiner during refining kept the stock wetted and the moisture content was maintained near the original level of about 71%. Agglomerated masses normally generated during refining were minimal. Dilution to 8% solids content before the addition of humectant, gave a slurry having good film casting characteristics. Physical properties of the cast product were: basis weight 70.2 g/m$^2$; caliper 0.0062 in.; tensile strength 300 g/in. MD and 370 g/in. CD.

A second portion of the refined stock above was diluted to 18% solids and passed through the refiner at 0.001 inch plate clearance. After diluting to 7% solids content, humectant was added and the slurry was cast, dried and remoistened before removal as a sheet. Physical properties were similar to the above product: basis weight 68.4 g/m$^2$; caliper 0.0059 in.; tensile strength 270 g/in. MD and 370 g/in. CD.

EXAMPLE 10

The tobacco mixture of Example 6 was refined to −850 ml CSF after eight passes at near zero plate clearance. Final moisture was about 63%. Agglomerated masses were dispersed by adjusting the moisture to 80% and then passing the slurry through a refiner with plate clearance set about 0.001 in. The stock was diluted to about 8% solids, humectant was added and the slurry was cast according to Example 4. Belt speed was about 6 ft/min. and a roll speed was about 8 ft/min.

Physical properties of the tobacco sheet were: 74.5 g/m$^2$; caliper 0.0063; tensile strength 360 g/in. MD and 389 g/in. CD. The cast product was substituted at a low level for strip tobacco in a cigarette blend. Control cigarettes contained the regular blend. A panel of smokers did not detect a significant difference in the smoking properties of the test versus the control cigarettes.

EXAMPLE 11

A blend of tobacco components was adjusted to 70% moisture and refined to −870 ml CSF. Final moisture was about 61%. The refined stock was diluted to 8.4% solids content, humectant was added and the agglomerated fiber masses were dispersed at about 40° F. during 16 to 18 hours agitation with a Lightning mixer. The slurry of dispersed refined tobacco was formed as a film on an endless stainless steel belt then dried, remoistened and removed in sheet form. Physical properties of the finished product were: basis weight 70 g/m$^2$; caliper 0.004 in.; tensile strength 340 g/in. MD and 430 g/in. CD.

EXAMPLE 12

Thirty pounds of tobacco dust, adjusted to 70% moisture, was refined to −860 ml CSF after eight passes through a double disc refiner set at near zero clearance. The refined stock was diluted to 12% solids and subjected to one pass through a colloid mill having rotor-stator clearance of essentially zero. A portion of the dispersed stock was further diluted to 10% solids, humectant was added, and the slurry formed into a thin film at 5 ft/min. using two consecutive rolls as described in Example 10. Physical properties were: basis weight 85 g/m$^2$; caliper 0.0075 in.; tensile strength 210 g/in. MD.

EXAMPLE 13

Stem fines were adjusted to 54% moisture and passed through a 36-inch atmospheric refiner at 0.006 inch plate clearance. The moisture was adjusted to about 60% and refining was continued for two more passes at 0.002 inch plate clearance. Freeness was −568 ml CSF. An equal amount of tobacco dust, containing less than 13% sand, was adjusted to about 60% moisture and added to the refined stems. This blend was passed twice through the refiner while plate clearance was essentially zero. The final moisture was about 54%. A portion of this refined stock, having a CSF of −840 ml, was diluted with sufficient water to give a slurry containing about 13% solids.

The refined material did not disperse readily, tending instead to remain in small agglomerated masses as noted in Example 3. Dispersion was incomplete after the slurry was pumped through a colloid mill at 20 psig and 0.007 inch rotor-stator clearance. A second pass at 0.001-inch clearance gave a smooth and creamy slurry which was then formed into a cast sheet at 6 ft/min. as described in Example 7. The tobacco sheet had the following properties: basis weight 77.5 g/m$^2$; caliper 0.0068 in.; tensile strength 243 g/in. MD and 300 g/in. CD.

Additional refinings of 1:1 mixtures of stem fines and tobacco dust at various moisture levels indicated the desirable freeness range could be reached under the following conditions. At an initial moisture of 60%, a freeness of −770 ml CSF was reached after three passes at near zero plate clearance. At about 50% moisture, the CSF was −780 ml after three passes and at about 45% moisture the CSF was −670 ml after two passes.

We claim:

1. A method of producing an all-tobacco material cast film comprising (a) mixing small particle tobacco material with water to attain a mixture with about 30 to about 50% by weight tobacco material;

(b) refining the wetted tobacco material to a CSF of −500 ml to −900 ml so as to rupture cell walls and reduce fiber length;

(c) passing the mixture through a colloid mill to reduce the size of any agglomerated materials without further refining of the remaining part of the mixture;

(d) diluting the refined mixture with water and humectant to form a slurry of a consistency suitable for film casting;

(e) casting the homogeneous slurry on a non-porous surface; and (f) drying the cast slurry.

2. A method of producing an all-tobacco material film comprising (a) mixing small particle tobacco material with water to attain a mixture having about 70% by weight moisture;

(b) refining the wetted tobacco material to a CSF of −500 ml to −800 ml to form a mixture which may contain agglomerates;

(c) diluting the mixture to 8% solids;

(d) substantially removing said agglomerates from the mixture by further treatment with a colloid mill;

(e) casting the mixture; and (f) drying the cast mixture to form a sheet.

3. A method of producing an all-tobacco cast sheet comprising (a) mixing tobacco particles with water to obtain a mixture at about 70% moisture;

(b) refining such mixture to about −800 ml to CSF;

(c) diluting the refined mixture to 12% solids;

(d) passing the diluted mixture through a colloid mill;

(e) further diluting the mixture to 10% solids; and (f) casting the further diluted mixture on a nonporous surface.

* * * * *